United States Patent [19]

Egert et al.

[11] 4,300,913

[45] Nov. 17, 1981

[54] APPARATUS AND METHOD FOR THE MANUFACTURE OF PRODUCT GAS

[75] Inventors: Klaus Egert; Wolfgang Heinrich; Klaus Lucas; Klaus-Otto Kuhlbrodt, all of Frieberg; Friedrich Berger, Brand-Erbisdorf; Peter Göhler, Freiberg; Manfred Schingnitz, Freiberg; Manfred Gross, Freiberg, all of German Democratic Rep.; Aleksander Jegorow; Vasilij Fedotov; Vladimir Gavrilin; Ernest Gudymov; Vladimir Semenov; Igol Achmatov, all of Moskwa; Nikolaj Majdurov, Moskovsk; Evgenij Abraamov, Moskwa, all of U.S.S.R.

[73] Assignees: Brennstoffinstitut Freiberg, Freiberg, German Democratic Rep.; Gosudarstwennyi Nautschno Issledowatelskij I Projektnyi Institut Asotnoj Promuschlennosti I Produktow Organitschekogo Sintesa, Moscow, U.S.S.R.

[21] Appl. No.: 104,892

[22] Filed: Dec. 18, 1979

[51] Int. Cl.[3] ..... C10J 3/72

[52] U.S. Cl. ..... 48/67; 48/69; 48/197 R; 48/DIG. 2; 55/223; 55/256; 261/159

[58] Field of Search ..... 48/DIG. 2, 62 R, 63, 48/69, 64, 73, 68, 76, 77, 197 R, 206, 215, 67; 110/215, 165 R, 266, 229, 258; 261/159, 152, 157; 55/256, 255, 245, 241, 223, 222, 95; 266/146, 236

[56] References Cited

U.S. PATENT DOCUMENTS

| | | | |
|---|---|---|---|
| 36,954 | 11/1862 | Jenkins et al. | 48/69 |
| 2,931,715 | 4/1960 | Eastman | 48/206 |
| 3,756,580 | 9/1973 | Dunn | 55/256 |
| 3,904,376 | 9/1975 | Kawata | 55/223 |
| 3,998,609 | 12/1976 | Crouch et al. | 48/215 |
| 4,218,423 | 8/1980 | Robin et al. | 48/69 |

*Primary Examiner*—S. Leon Bashore
*Assistant Examiner*—Michael L. Goldman
*Attorney, Agent, or Firm*—Michael J. Striker

[57] ABSTRACT

Product gas resulting from the partial oxidation of finely divided fuel in a reactor is discharged as a stream into a tube leading downwardly into a vessel containing a water bath in which the lower end of the tube is immersed. Liquid slag produced during the partial oxidation is also discharged as a solid stream within and surrounded by the stream of product gas. The tube is cooled by circulating cooling water upwardly through an annular clearance in the tube which is discharged from the annular clearance at the upper end of the tube for gravity descent as a liquid film along the inside of the tube. The slag becomes cooled and granulated on contact with the water bath and is discharged from the vessel in granulated condition. The gas escapes from the lower open tube end, travels upwardly through the water bath to become cooled thereby, and is then discharged from the vessel in cooled condition.

4 Claims, 1 Drawing Figure

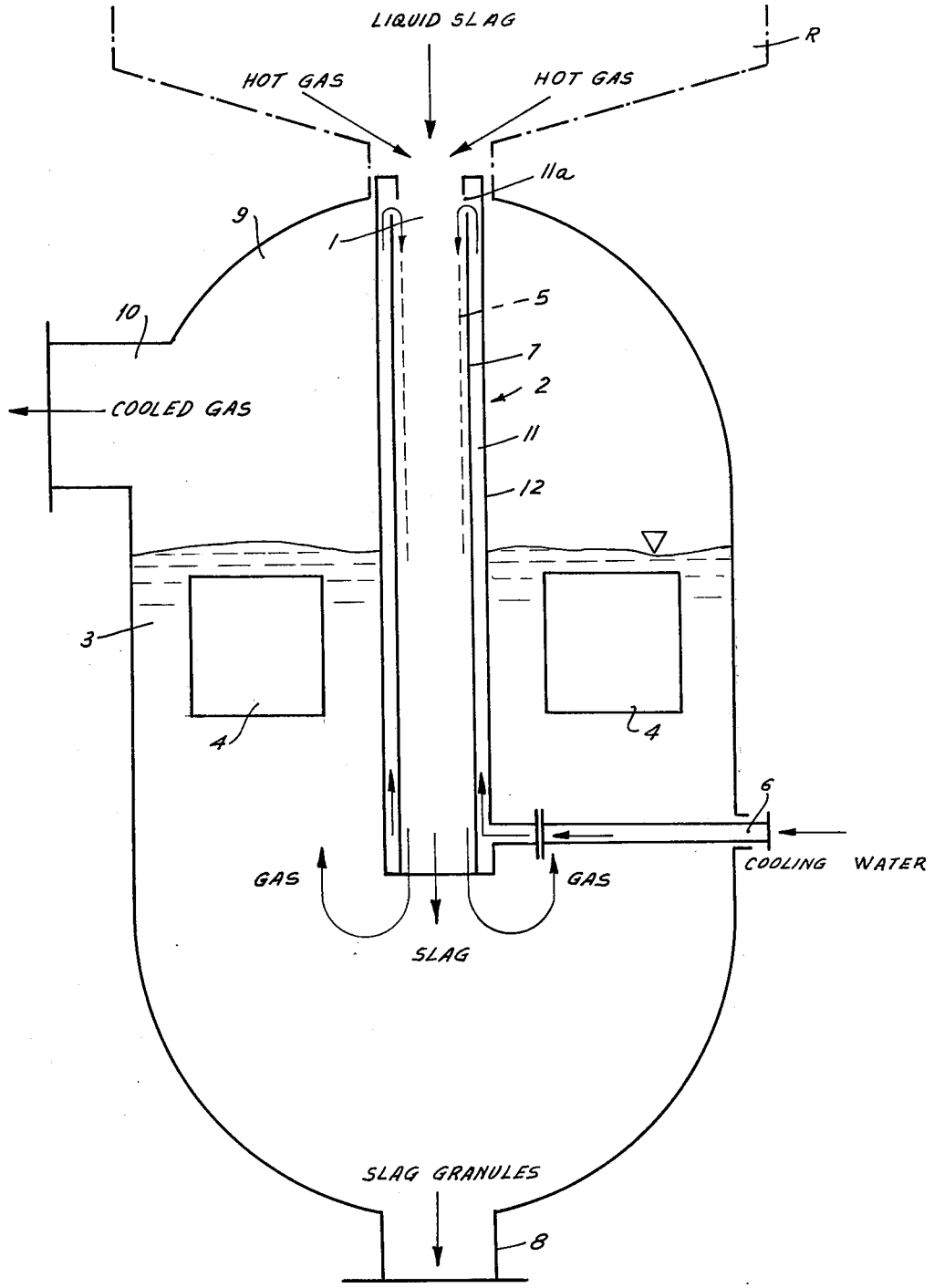
LIQUID SLAG
R
HOT GAS
HOT GAS
11a
9
1
5
10
7
2
COOLED GAS
11
12
3
4
4
6
COOLING WATER
GAS
GAS
SLAG
SLAG GRANULES
8

APPARATUS AND METHOD FOR THE MANUFACTURE OF PRODUCT GAS

BACKGROUND OF THE INVENTION

This invention relates to the manufacture of product gas in general.

More particularly, the invention relates to a method and apparatus for producing gas in a reactor by oxidation of finely divided fuel, with concomitant formation of liquid slag.

Still more specifically, this invention relates to a method and an apparatus for simultaneously cooling both the product gas and the liquid slag which are generated in a reactor under the aforementioned operating conditions.

It is known from the prior art to gasify in a reactor finely divided gas-suspended solid and liquid fuels to autothermally and at elevated pressure manufacture CO and $H_2$-containing product gases. The term "finely divided" is a term of art meaning that the fuels are present in form of small particles, in form of dust or, when liquid fuel is involved, in form of small droplets. If these fuels are of the high-ballast type, i.e. the type containing a high percentage of non-oxidizable residue (ash), then the level of the required reaction temperatures requires that these residues be converted into liquid slag so as to prevent their sinter deposition on portions of the reactor, because this could lead to blockage of the flow paths and/or to a reduction of the reactor volume. This liquid slag must be discharged from the reactor, either together with or independently of the product gas manufactured in the reactor.

To facilitate later handling, the liquid slag is cooled with water to cause it to solidify and become converted into slag granules. The problem with this is that it results in the formation of steam which tends to have a cooling effect on the oncoming liquid slag, increasing the viscosity of the same and leading to increased clogging of the slag outlets from the reactor.

A proposal has been made in German Published Application OS 2,723,601 to discharge the liquid slag from the reactor into a water-cooled tube whose lower end is immersed in a water bath, so that the slag becomes granulated when it drops into the water.

However, the subsequent uses of the product gas require that not only the slag but also the product gas itself be cooled, and this cannot be achieved with the aforementioned proposal.

SUMMARY OF THE INVENTION

Accordingly, it is an object of the present invention to provide further improvements over the prior art.

A more particular object of the invention is to prevent clogging of the reactor outlets, and potentially dangerous overheating of equipment due to insufficiently cooled product gas, without requiring substantial technical and financial expenditures.

Still more specifically, it is an object of the invention to provide an improved method which enables achievement of the aforementioned purposes, and an improved apparatus for carrying out the invention.

Another object is to permit the simultaneous cooling of the liquid slag as well as of the product gas.

A concomitant object is to utilize the beneficial effect of the hot product gas, namely the fact that when the product gas and slag are discharged together the product gas surrounding the slag will keep the flowing slag at the temperature required to keep it flowing until entry into the water bath, and that the product gas prevents the access of the comparatively cool steam to the outlet opening or openings of the reactor from which the product gas and liquid slag both issue.

In keeping with these objects and with still others which will become apparent hereafter, one aspect of the invention resides—in a method of producing gas in a reactor by oxidation of finely divided fuel with concomitant formation of liquid slag—in the steps of discharging from the reactor a stream of the product gas and a stream of liquid slag within and surrounded by the stream of product gas; passing the streams downwardly into a vessel through a double-walled discharge tube having an annular clearance between its walls and also having a lower open end immersed in a water bath in the vessel, circulating a cooling liquid in counterflow to the streams through the annular clearance; discharging the slag, which becomes cooled and granulated on entry into the water bath, from a lower part of the vessel; cooling the product gas during ascent of the same through the water bath from the lower open end of the discharge tube; and discharging the cooled product gas from an upper part of the vessel.

An apparatus for carrying out the method may comprise a vessel having an upper part and a lower part for containing a water bath; an upright discharge tube extending downwardly from said upper part and having a lower open end immersed in the water bath, the tube also having double walls which define between themselves an annular clearance and an upper inlet for receiving a stream of product gas from the reactor and within and surrounded by the gas stream a stream of liquid slag; means for circulating a cooling liquid through the annular clearance in counterflow to the gas and slag streams; means for discharging from the lower part of the vessel the slag which has become cooled and granulated on entry into the water bath; and means for withdrawing from the upper part of the vessel the cooled product gas which has ascended from the lower open tube end through the water bath.

The novel features which are considered as characteristic are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The sole FIGURE is a diagrammatic illustration of an apparatus pursuant to the invention.

DESCRIPTION OF THE PREFERRED EMBODIMENT

The method and apparatus according to the invention will now be jointly described with reference to the FIGURE, wherein the actual gasifying reactor R is shown only diagrammatically in broken lines. The reactor itself is known per se and does not form a part of the present invention, which is concerned with the processing of the product gas and liquid slag which issue from the reactor.

With this in mind it will be seen that a vessel 9 is provided which has an inlet 1 through which it receives a stream of hot product gas from the reactor R, as well as continuous stream of liquid slag which passes through the center of the product gas stream, i.e. is surrounded by the same on all sides.

The lower part of vessel 9 contains a water bath 3 and an upright tube composed of an inner wall 7 and an outer wall 12 defining with the inner wall 7 an annular clearance 11, is mounted in the vessel 9, preferably concentrically therewith. The upper open end of tube 2 is positioned to receive the gas stream and slag stream entering the inlet of vessel 9; the lower end of tube 2 is immersed in the water bath 3. A supply conduit 6 for cooling liquid (usually water) communicates with the clearance 11 near the lower end thereof; the lower end of clearance 11 is closed, whereas the upper end of the clearance has one or more openings 11*a* (preferably a slotshaped opening or an annulus of openings) communicating with the interior of tube 7. Cooling water admitted in a quantity (in the concrete example about 80,000 kg/h and at a temperature of about 150° C.) through conduit 6 therefore rises in the clearance 11, cooling the inner surface of tube 7 indirectly by heat exchange with the outer surface of the tube 7. The cooling water then runs through the opening or openings 11*a* onto the inner surface of tube 7 (see the arrows) and runs over this inner surface under the influence of gravity, forming a water film 5 in the inner surface which effects direct cooling thereof. Unnoticed—or not immediately noticed—fluctuations in operating parameters (e.g., gas-flow fluctuations resulting from pressure changes or else fluctuations in the coolingwater flow) may at times result in the water film on the inner surface of tube 7 becoming disrupted. This could lead to local overheating and destruction of the wall of tube 7, permitting uncooled product gas to subsequently come into contact with low-temperature equipment located downstream of the product-gas outlet 10 of vessel 9 and to cause damage to such equipment. The fact that the clearance 11 is always filled with water and that there is, therefore, always at least indirect cooling of the inner surface of tube 7, prevents this possibility.

The inner diameter of tube 7 may, in a concrete example, be 640 mm. Let it be assumed that the stream of product gas entering the tube from the reactor at a temperature of 1300° C. and a pressure of 25 bar amounts to 1200 $m^3$/h, and the stream of liquid slag enters in a quantity of 2000 kg/h (there is no contact of the slag with the tube 7 because the slag stream is surrounded by the gas stream). The effective flow speed of the gas stream in tube 7 will then be about 10 m/sec. At this speed the slag stream is not interfered with; i.e., there is no dispersing of the slag stream to be observed which would otherwise lead to caking of the slag on the tube wall despite the water film. According to the invention the gas flow speed may be lower than 10 m/sec, but not significantly lower than 8 m/sec, because at too low flow speeds the access of water vapor from the bath 3 to the inlet from the reactor R is not precluded by the hot product gas, and this would then lead to solidification of the slag at this inlet and to partial or full clogging of the inlet.

The lower end of tube 2 is immersed in the water bath 3 to a depth of about 1200 mm in this concrete example. The stream of gas and slag displaces the water of bath 3 from the immersed portion of tube 2. The gas escapes at the open end of tube 2 and travels upwardly through the water bath 3, in which it is widely dispersed by baffles 4 installed in the water bath, so as to become cooled to the maximum possible extent before it rises above the bath 3 and is discharged in outlet 10.

The stream of liquid slag enters into the water bath 3 at the lower end of tube 2, having been only slightly cooled during its passage through tube 2 because of the presence of the gas stream, and becomes solidified and breaks up into granules on entry into the bath 3. These granules can then be discharged from vessel 9 via an outlet 8.

The product gas becomes cooled down almost to the temperature of water bath 3 by the time it leaves through outlet 10. It has become saturated with steam up to the vapor pressure of the water and, rather than constituting a disadvantage, this vapor content of the gas can be utilized in the subsequent operating stages.

While the invention has been illustrated and described as embodied in the manufacture of product gas, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be secured by Letters Patent is set forth in the appended claims.

1. In a method of producing gas in a reactor by oxidation of finely divided fuel with concomitant formation of liquid slag, the steps of discharging from the reactor a stream of the product gas and a stream of liquid slag which travels within and is surrounded by the stream of product gas; passing the streams downwardly into a vessel through a straight central passage of a vertical doublewalled discharge tube having an annular clearance between its walls and also having a lower open end immersed in a water bath in the vessel; circulating a cooling liquid in counterflow to the streams through the annular clearance; admitting said cooling liquid at an upper end portion of the discharge tube from the annular clearance onto an inner surface of the discharge tube, for gravity descent on and along the inner surface as a liquid film which prevents local overheating or destruction of the tube; discharging the slag, which becomes cooled and granulated on entry into the water bath, from a lower part of the vessel; cooling the product gas during ascent of the same through the water bath from the lower open end of the discharge tube; and discharging the cooled product gas from an upper part of the vessel.

2. In an apparatus for producing gas by oxidation of finely divided fuel in a reactor with concomitant formation of liquid slag, a combination comprising a vessel having an upper part and a lower part for containing a water bath; a vertically oriented straight discharge tube extending downwardly from said upper part and having a lower open end immersed in the water bath, said tube also having double walls which define between themselves an annular clearance and an upper inlet for receiving a stream of product gas from the reactor and a stream of liquid slag which is within and surrounded by the gas stream so that the gas stream prevents contact between the slag and the discharge tube; means for circulating a cooling liquid through the annular clearance in counterflow to the gas and slag streams; means for admitting said cooling liquid at an upper end portion of the discharge tube from the annular clearance onto an inner surface of the discharge tube, for gravity descent on and along the inner surface as a liquid film which prevents local overheating or destruction of the tube; means for discharging from the lower part of the vessel the slag which has become cooled and granulated on entry into the water bath; and means for withdrawing from the upper part of the vessel the cooled product gas which has ascended from the lower open tube end through the water bath.

3. A method as defined in claim 1, wherein the flow speed of the stream of product gas in the discharge tube is between substantially 8–10 m/sec.

4. A combination as defined in claim 2, wherein said tube is arranged concentrically in said vessel.

* * * * *